US009117578B2

(12) United States Patent
Hahn et al.

(10) Patent No.: US 9,117,578 B2
(45) Date of Patent: Aug. 25, 2015

(54) NO-INSULATION MULTI-WIDTH WINDING FOR HIGH TEMPERATURE SUPERCONDUCTING MAGNETS

(71) Applicant: Massachusetts Institute of Technology, Cambridge, MA (US)

(72) Inventors: Seung-Yong Hahn, Chestnut Hill, MA (US); Yukikazu Iwasa, Weston, MA (US); Juan Bascunan, Burlington, MA (US); Dong Keun Park, Seoul (KR)

(73) Assignee: Massachusetts Institute of Technology, Cambridge, MA (US)

( * ) Notice: Subject to any disclaimer, the term of this patent is extended or adjusted under 35 U.S.C. 154(b) by 128 days.

(21) Appl. No.: 13/800,052

(22) Filed: Mar. 13, 2013

(65) Prior Publication Data

US 2015/0213930 A1 Jul. 30, 2015

Related U.S. Application Data

(60) Provisional application No. 61/610,071, filed on Mar. 13, 2012.

(51) Int. Cl.

| | |
|---|---|
| ***H01F 1/00*** | (2006.01) |
| ***H01F 6/00*** | (2006.01) |
| ***H01F 6/06*** | (2006.01) |
| ***H01F 41/04*** | (2006.01) |

(52) U.S. Cl.

CPC ..... *H01F 6/06* (2013.01); *H01F 41/048* (2013.01)

(58) Field of Classification Search

CPC ..... H01F 6/00; H01F 6/06

USPC ..... 505/211; 335/216

See application file for complete search history.

(56) References Cited

U.S. PATENT DOCUMENTS

| | | | | |
|---|---|---|---|---|
| 4,682,134 | A * | 7/1987 | Laskaris | 335/215 |
| 4,760,365 | A | 7/1988 | Bailey et al. | |
| 5,310,705 | A * | 5/1994 | Mitlitsky et al. | 505/211 |
| 5,426,408 | A * | 6/1995 | Jones et al. | 505/211 |
| 5,525,583 | A * | 6/1996 | Aized et al. | 505/211 |
| 5,581,220 | A * | 12/1996 | Rodenbush et al. | 335/216 |
| 5,604,473 | A * | 2/1997 | Rodenbush | 335/216 |
| 5,659,277 | A * | 8/1997 | Joshi et al. | 335/216 |
| 5,668,516 | A * | 9/1997 | Xu et al. | 335/216 |
| 5,914,647 | A * | 6/1999 | Aized et al. | 335/216 |
| 6,215,384 | B1 * | 4/2001 | Laskaris et al. | 335/299 |

(Continued)

OTHER PUBLICATIONS

Juan Bascunan; Seungyong Hahn; Dong Keun Park; Yukikazu Iwasa; A 1/3-GHz LTS.HTS NMR Magnet—A Progress Report; IEEE Transactions on Applied Superconductivity, vol. 21, No. 3. Jun. 2011 p. 2092-2095.

(Continued)

*Primary Examiner* — Alexander Talpalatski

(74) *Attorney, Agent, or Firm* — Peter A. Nieves; Sheehann Phinney Bass + Green PA

(57) ABSTRACT

An HTS magnet having a stack of a plurality of double-pancake (DP) coils is disclosed, with each DP coil having a first superconducting coil and a second superconducting coil. The plurality of DP coils have varying widths, with DP coils with the widest widths at the top and bottom of the stack, and DP coils with the narrowest coils located substantially at a midpoint of the stack. The DP coils omit turn-to-turn insulation, or have minimal turn-to-turn insulation.

20 Claims, 9 Drawing Sheets

(56) References Cited

U.S. PATENT DOCUMENTS

| | | | | |
|---|---|---|---|---|
| 7,474,515 | B2 * | 1/2009 | Mallett | 361/19 |
| 7,825,760 | B2 * | 11/2010 | Bird et al. | 335/299 |
| 7,859,374 | B2 * | 12/2010 | Iwasa et al. | 335/216 |
| 8,228,148 | B2 * | 7/2012 | Iwasa et al. | 335/216 |
| 8,487,727 | B2 * | 7/2013 | Wu et al. | 335/216 |
| 2006/0077025 | A1 * | 4/2006 | Funaki et al. | 335/216 |
| 2007/0171014 | A1 * | 7/2007 | Iwasa et al. | 335/216 |
| 2010/0254047 | A1 | 10/2010 | Martchevskii | |
| 2011/0140817 | A1 * | 6/2011 | Fukaya et al. | 335/216 |

OTHER PUBLICATIONS

D. Evans; Turn, Layer and Ground Insulation For Superconducting Magnets; Physica C 354 (2001) p. 136-142.

S. Hahn; J. Bascunan; W. Yao; Y. Iwasa; two HTS Options for a 600 MHz Insert of a 1/3 GHz LTS/NMT Magnet: YBCO and BSCCO; Physica C 470 (2010) 1721-1726.

Martin Wilson; Superconducting Magnets; Clarendon Press Oxford: 1983, p. 46-47.

Kang, M. et al; Characteristics of Magnets Depending on the Width of High Temperature Superconducting Tapes Applied to the Outer Pancake Windings, International Conference on Magnet Technology; No. 22, Merseille, France. Dec. 9, 2011.

Hahn, S. et al; HTS Pancake Coils without Turn-To-Turn Insulation, Applied Superconductivity, IEEE Transactions, vol. 21, Issue 3, Dec. 23, 2010.

Hazelton, D. et al; Recent Developments in 2G HTS Coil Technology, IEEE/CSC & ESAS European Superconductivity News Forum, No. 6, Oct. 2008.

* cited by examiner

NO-INSULATION MULTI-WIDTH WINDING FOR HIGH TEMPERATURE SUPERCONDUCTING MAGNETS

CROSS-REFERENCE TO RELATED APPLICATIONS

This application claims the benefit of U.S. Provisional Patent Application Ser. No. 61/610,071, filed Mar. 13, 2012, entitled "NO-INSULATION MULTI-WIDTH WINDING FOR HIGH TEMPERATURE SUPERCONDUCTING MAGNETS," which is incorporated by reference herein in its entirety.

STATEMENT REGARDING FEDERALLY SPONSORED RESEARCH OR DEVELOPMENT

This invention was made with government support under Grant No. R01 RR015034 awarded by the National Institutes of Health. The government has certain rights in this invention.

FIELD OF THE INVENTION

The present invention relates to electro-magnetics, and more particularly, is related to high temperature superconducting magnets.

BACKGROUND OF THE INVENTION

High resolution nuclear magnetic resonance (NMR) spectroscopy of liquid samples is a widely utilized analytical technique in diverse applications ranging from pharmaceutical discovery and development of new drugs, to on-line reaction monitoring, to human biomarker metabolomics. A market for affordable, high-performance, low maintenance cost, small footprint magnets already exists and should grow significantly in this decade.

A typical all-low temperature superconducting (LTS) NMR magnet wound with NbTi and/or Nb3Sn wires requires operation either at <4.2 mostly with use of liquid helium (LHe). The magnet has three operational challenges: 1) high susceptibility to quench, because of its extremely low thermal stability; 2) large size, because of the low-current carrying capacities of LTS at ≥12 T; and 3) high cryogenic cost, because of its reliance on LHe. Although a zero boil-off cryogenic system is now a Magnetic Resonance Imaging (MRI) market standard and even used in some NMR magnets, helium prices have doubled from 2002 to 2007 and are still rising. A high temperature superconducting (HTS) magnet operated at ≥10 K, may provide practical solutions to these challenges; inherent thermal stability; higher current-carrying capacities; and no absolute requirement for operation at <10K.

HTS magnets may be formed by coils of a superconducting material, for example single- or double-pancake. As shown by FIG. 1, the superconducting material may be in the form of a thin tape 110. The tape 110 may be wrapped or layered with an insulating material. The tape 110 may be wound around a circular bobbin (not shown), to form a first coil 120. Then the second coil 140 may be continuously wound on top of the first coil 120, for example, on the same bobbin, to form a double-pancake (DP) coil structure 200, as shown by FIG. 2, where there is a cross-over turn 125 between the first coil 120 and the second coil 140.

Insulation is generally considered indispensable to both superconducting and resistive electromagnets. However, except for ensuring a specific current path within a winding, insulation is undesirable in several aspects. First, the insulation, generally organic, makes a winding elastically soft and increases mechanical strain of the winding under a given stress ("spongy effect"). Second, insulation reduces the overall current density of the winding. For example, in the case of 2G (second generation) HTS having an overall thickness is nearly the same as that of a typical insulator, the current density may be reduced roughly by half. Third, insulation electrically isolates every turn in a winding and prevents, in the event of a quench, current bypassing through the adjacent turns, which may cause overheating in the quench spot. Therefore, use of thick stabilizer, typically Cu, to protect HTS magnets from permanent damage is common, resulting in large magnets. While recent progress in the current-carrying capacity of 2G HTS makes it feasible to build >35 T superconducting magnets, these issues still remain big technical challenges.

In general, magnet protection, for example, from overheating in an event of quench, is one of the major factors that limit HTS magnet current density. Therefore, there is a need in the industry to overcome the abovementioned shortcomings.

SUMMARY OF THE INVENTION

Embodiments of the present invention provide no-insulation multi-width winding for high temperature superconducting magnets. Briefly described, the present invention is directed to a high-field HTS magnet having a stack of a plurality of double-pancake (DP) coils, each DP coil having a first superconducting coil and a second superconducting coil. The device includes a first DP coil having a first width disposed at a top of the stack, a second DP coil having a second width disposed at a bottom of the stack, and a third DP coil having a third width disposed substantially at a midpoint of the stack. The first width is substantially equal to the second width, and the third width is substantially narrower than the first width. The plurality of superconducting coils may substantially omit a turn-to-turn insulation.

A second aspect of the present invention is directed to a method of forming a high-field HTS magnet having a plurality of DP coils, each DP coil having a first superconducting coil and a second superconducting coil. The method includes the steps of forming a first DP coil and a second DP coil having a first width, forming a third DP coil having a second width, wherein the second width is substantially narrower than the first width, and forming a stack of adjacent DP coils having the first DP coil disposed at a top of the stack, the second DP coil disposed at a bottom of the stack, and the third DP coil disposed substantially at a midpoint of the stack. The plurality of superconducting coils may substantially omit a turn-to-turn insulation.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1:
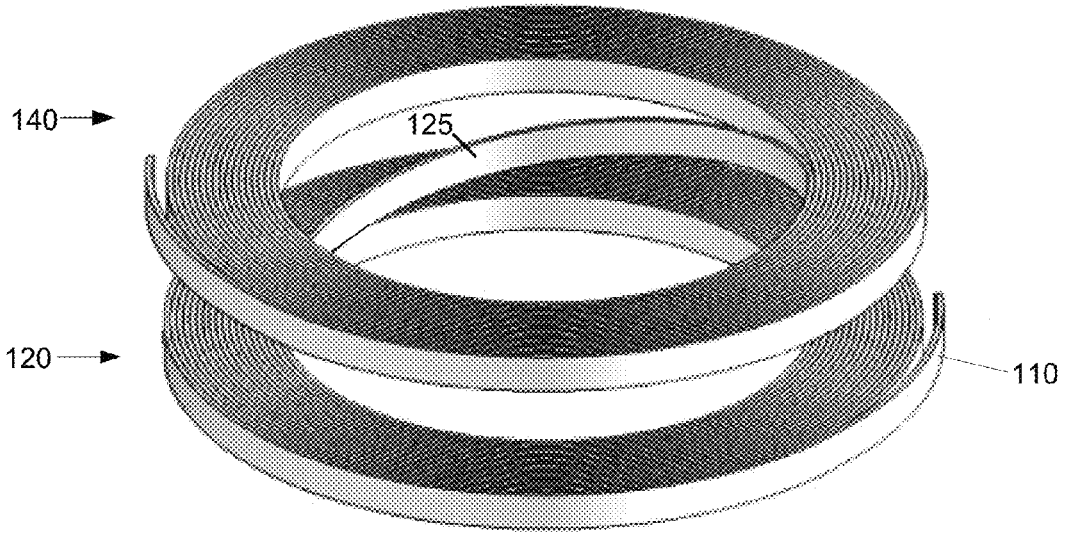
FIG. 1 (PRIOR ART)
FIG. 1 is a schematic diagram of prior art double pancake HTS magnet coils in exploded view.
Figure 2:
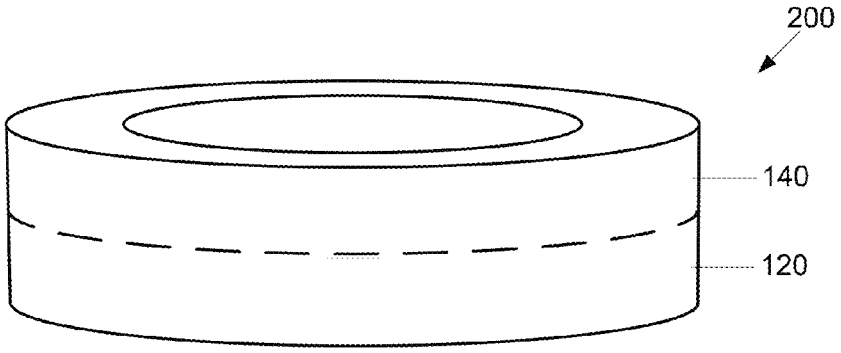
FIG. 2 (PRIOR ART)
FIG. 2 is a schematic diagram of prior art double pancake HTS magnet coils.

Reference will now be made in detail to embodiments of the present invention, examples of which are illustrated in the accompanying drawings. Wherever possible, the same reference numbers are used in the drawings and the description to refer to the same or like parts.

Exemplary embodiments of a nuclear magnetic resonance No-Insulation (NI) double-pancake (DP) winding with Multi-Width (MW) 2G HTS device and method are presented. The NI DP MW 2G HTS provides a highly-integrated HTS winding. Use of NI windings enables an HTS magnet to be self-protecting for operation at a high current density (>100 kA/cm$^2$ [1.5]) which would damage a conventional HTS magnet. Further, the multi-width arrangement provides an effective approach to grade tape-wound DP coils. Combining NI and MW enables HTS magnets to be highly compact, resulting in significant reduction in magnet price, capital and operation.

The following definitions are useful for interpreting terms applied to features of the embodiments disclosed herein, and are meant only to define elements within the disclosure. No limitations on terms used within the claims are intended, or should be derived, thereby. Terms used within the appended claims should only be limited by their customary meaning within the applicable arts.

As used within this disclosure, a "2G conductor" is a second generation (2G) high temperature superconductor wire. The 2G wire is a fundamentally different technology than first generation wire (1G), the 2G wire including a high-performance 1-2 micron thin YBCO epitaxial layer deposited on a bi-axially textured oxide buffered metal tape. The 2G wire generally includes a textured template that enables the growth of the biaxially aligned YBCO and a superconducting YBCO layer. Here YBCO is a high temperature superconductor YBa2Cu3O7-x.

As used within this disclosure, a "pancake" refers to a substantially cylindrical structure formed of a coiled superconductor and/or conductor, and described in terms of an inner diameter of the coil, an outer conductor of the coil, and a substantially uniform thickness, or width of the coil. Other defining characteristics include the type of wire forming the coil, the presence or absence of an insulating layer and the number of wire windings in the coil.

As used within this disclosure, a "stack" refers to a structure formed of two or more concentrically aligned pancakes. The two or more pancakes forming a stack are substantially adjacent to one another.

NI Pancake Coils

Figure 3:
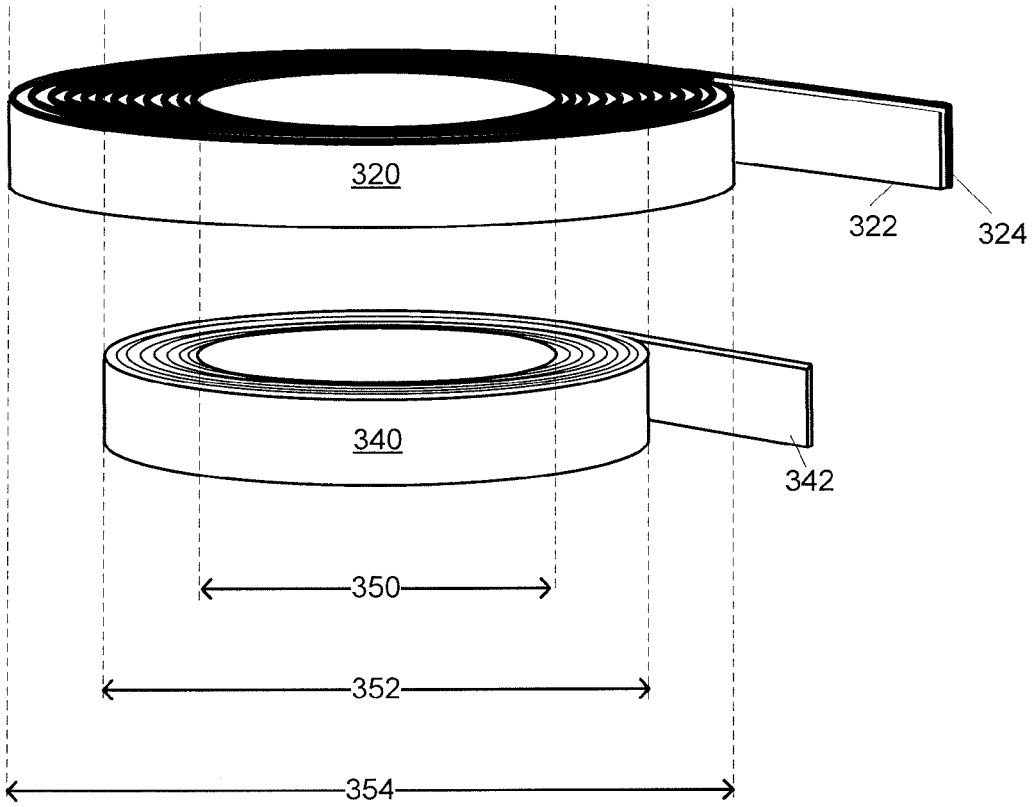
FIG. 3 is a first schematic diagram comparing the width of a no insulation pancake coil to a prior art single pancake coil.

FIG. 3 compares a conventional insulated (INS) single-pancake coil 320 with an NI single-pancake coil 340. The INS coil 320 is formed with a superconductor tape 322 including a thick insulator backing 324 to provide insulation between adjacent turns in the INS coil 320, and a thick extra stabilizer, for example, Cu, to provide thermal stability of the INS coil 320 during protection that is not necessary for the NI counterpart 340 due to the self-protecting feature of the NI coil 340. The thick insulator backing 324 and the thick extra stabilizer adds a considerable amount of volume to the INS coil.

Both the INS coil 320 and the NI coil 340 have the same inner diameter 350, and the same number of coil windings. The thickness of the insulator backing 322 and the extra stabilizer contributes significantly to the outer diameter 354 of the INS coil 320. In contrast, the NI coil 340 does not have an insulating layer and an extra stabilizer layer, resulting in the NI coil 340 having a considerably smaller outer diameter 352, in comparison with the outer diameter 354 of the INS coil 320.

In alternative embodiments, the NI coil may have a partial insulation consisting of some insulating layers, although the number of the insulating layers is considerably smaller than that of the conventional INS coil 320.

Figure 4B:
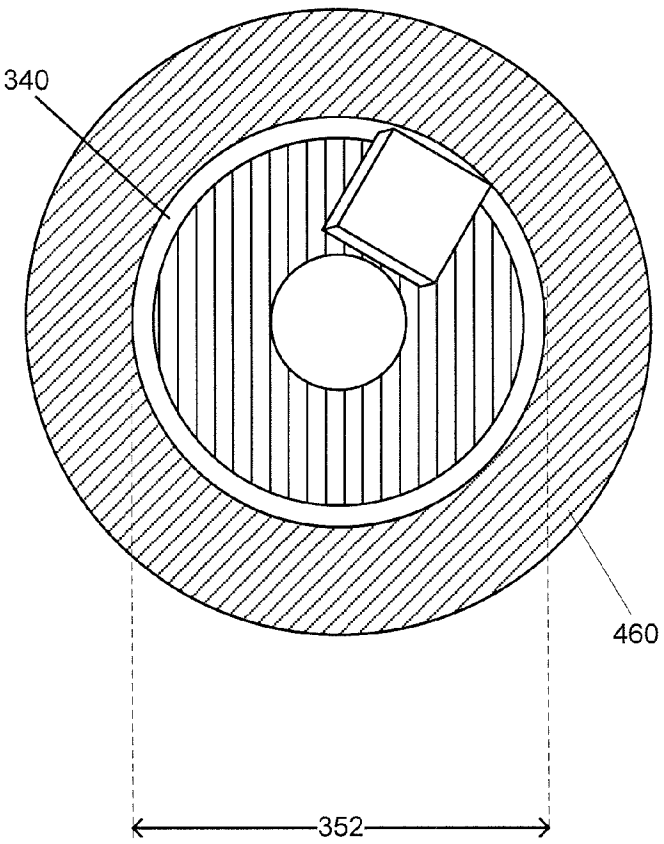
FIG. 4B is a schematic diagram of a no insulation pancake coil mounted on a bobbin.
Figure 4A:
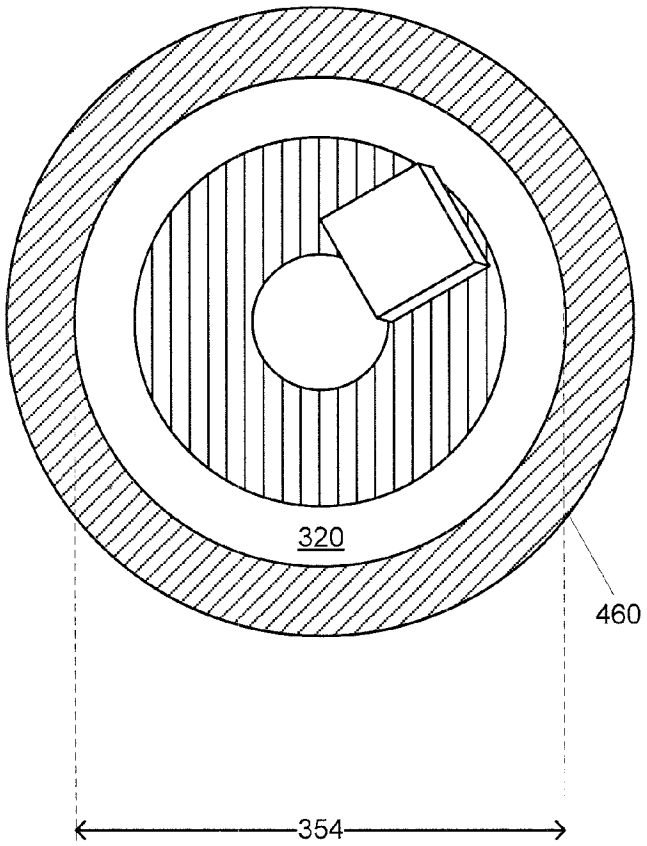
FIG. 4A is a schematic diagram of a prior art single pancake coil mounted on a bobbin.

The NI coil 340 provides a higher current density than the INS coil 320. FIGS. 4A and 4B present alternative views of two single-pancake 2G coils mounted on bobbins 460, comparing a conventional insulated (INS) coil 320 (FIG. 4A) and a NI coil 340 (FIG. 4B). The number of turns, winding inner diameter, and center field of each coil are identical, but the NI coil 340 has less diameter, for example, 3.6 times less radial build than the INS coil 320. Test results have shown that NI coils are more stable in operation than their INS counterparts. Furthermore, the MW technique, described below, essentially a conductor-grading technique, significantly enhances overall current density of a DP magnet without an increase of operating current. Although the NI and MW techniques can be separately used, a combination of these two techniques, each applied for the first time to HTS coils, makes these coils exceptionally "high-performance," as described further below.

Multi-Width

Commercial 2G conductor is generally available as tape with width/thickness ratio in a range of 5-40. In a conventional assembly 505 of prior art double-pancake (DP) coils 540, as shown in FIG. 5A, each of the DP coils in the stack 505 is wound with the same-width 2G tape.

Figure 5B:
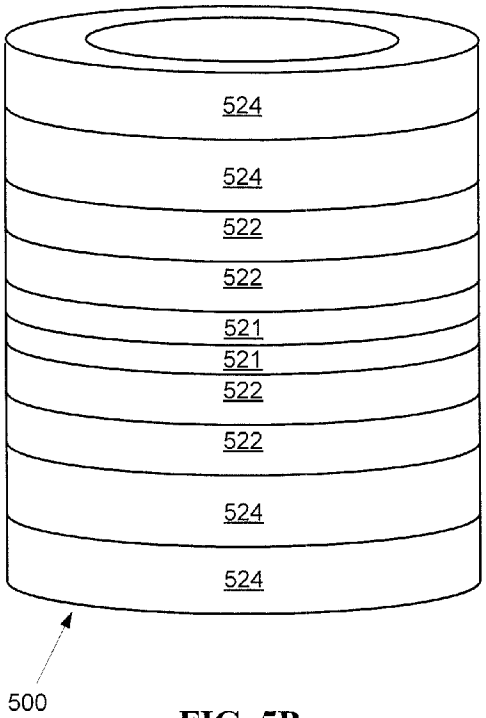
FIG. 5B is a schematic diagram of a multi-width DP stack.
Figure 5A:
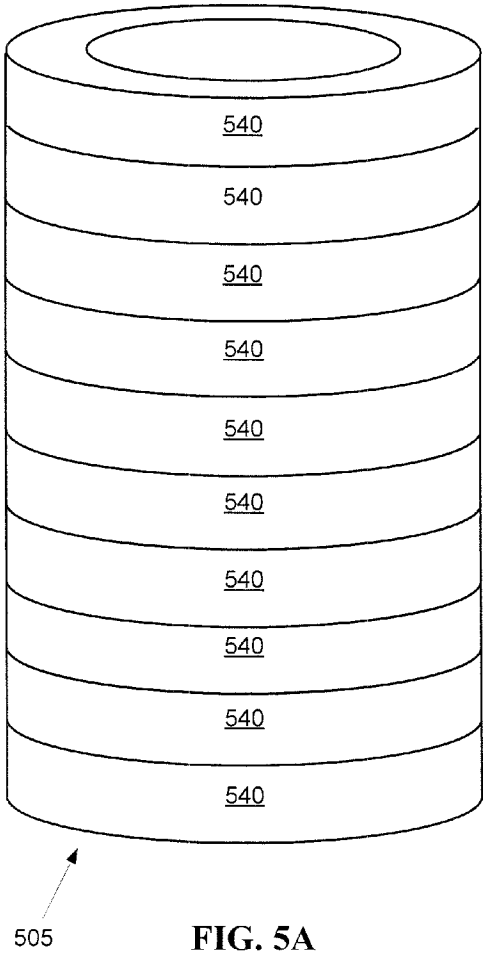
FIG. 5A (PRIOR ART)
FIG. 5A is a schematic diagram of a prior art uniform width DP stack.

A first exemplary embodiment of an NI multi-width DP stack 500 is shown by FIG. 5B. Unlike the conventional assembly 505 of double-pancake coils of FIG. 5A, where each of the DP coils 540 in the stack 505 are wound with the same-width 2G tape, the multi-width stack 500 uses DP coils 521, 522, 524 having different widths, each paired as a mirror image to the axial mid-plane of the stack 500. Narrow width DP coils 521 are formed of the narrowest tape width and positioned near the magnet mid-plane of the multi-width stack 500. DP coils of gradually wider tapes are located progressively further away from the mid-plane of the stack 500, with the widest-tape DP coils 524 at the top and bottom, where the normal field that limits 2G tape performance is at its peak. Medium width DP coils 522 are formed with 2G tape having medium width. Medium width DP coils 522 are positioned above the narrow width DP coils 521, and medium width DP coils 522 are positioned below the narrow width DP coils 521. Widest width DP coils 524 are formed with 2G tape having a widest width. Widest width DP coils 524 are positioned above the medium width DP coils 522 at the top of the stack 500. Widest width DP coils 524 are also positioned below the medium width DP coils 522 at the bottom of the stack 500. This multi-width technique, as adapted here DP coils, significantly enhances the overall current density of such a coil assembly 500 at a given operating current density of such a coil assembly 500.

"Perpendicular Field" and Current-Carrying Capacity of HTS Magnet

The current carrying capacity of every superconducting wire degrades as the applied field to the wire increases. In prior art commercial HTS conductors, currently available generally as tape with width/thickness ratio in a range of 5-40, a field "perpendicular to the tape surface" dominates, rather than a field parallel to the tape surface, the current carrying capacity of the tape under an external field, referred to as the in-field performance of the conductor. FIG. 6A presents a schematic drawing showing a cutaway view of a prior art double-pancake (DP) stacked HTS magnet 505 where all the DP coils 540 are connected in series, and are therefore operated at the same operating current. Here, the peak $B_r$ (radial component of magnetic field as the "perpendicular" field to the HTS tapes) in the entire DP assembly 505 occurs at the top and bottom DP coils 540 and it dominantly limits the current carrying capacity (the field generation capacity) of the entire HTS magnet 505. At a given operating current, for example, but not limited to 100 A, though the DP coils 540 placed near the magnet center where the $B_r$ is "small" and can carry much higher currents significantly above 100 A, the entire magnet must be operated at the low current (100 A) chiefly due to the largest perpendicular field impact on the in-field performance of the top and bottom DP coils 540 under the condition that all the DP coils 540 are connected in series.

Figure 6B:
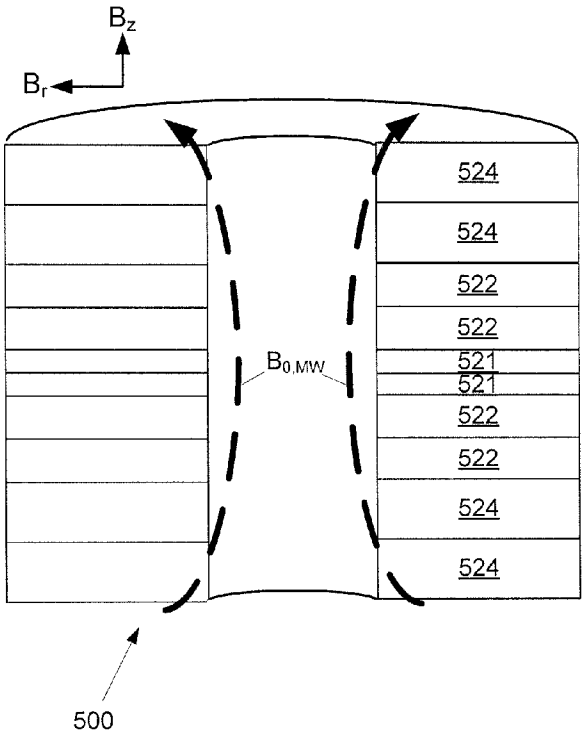
FIG. 6B is a schematic cutaway diagram of a multi-width DP stack.
Figure 6A:
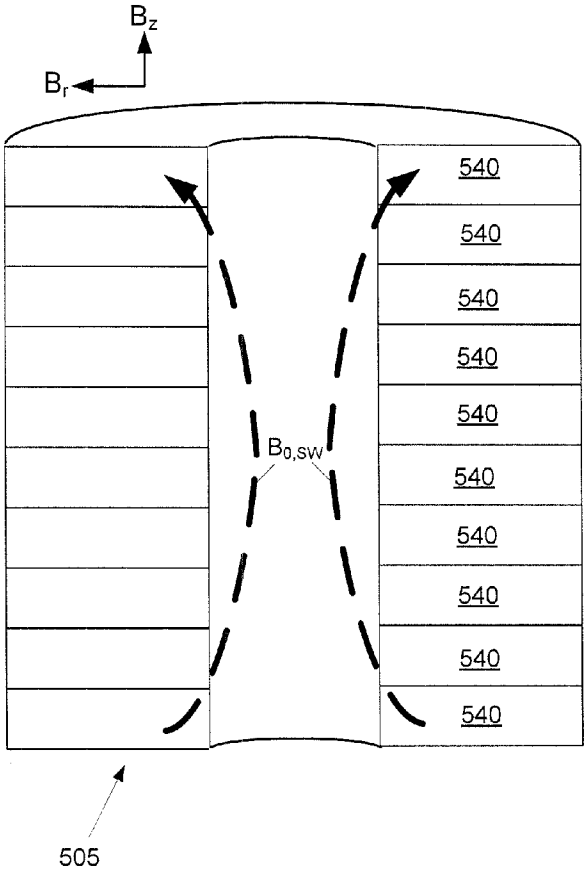
FIG. 6A (PRIOR ART)
FIG. 6A is a schematic cutaway diagram of a prior art uniform width DP stack.

In contrast, a multi-width DP pancake stack 500 as shown in FIG. 6B places DP coils 521 of the narrowest tape width at and near the magnet mid-plane of the stack 500, placing DP coils 522 of gradually wider tapes away from the mid-plane, with the widest-tape DP coils 524 at the top and bottom of the stack 500, where the perpendicular (radial) field that limits the HTS tape performance is at its peak. A key point is that the tape width of the DP coils 521, 522, 524 should "gradually" increase (for example, but not limited to, by every 0.5-1 mm) so that the radial magnetic field component $B_r$ in the "narrowest" DP coils remains very small. For an example, if the width of the wider DP coils 524 (here 8 mm) is simply doubled to that of the narrowest coils (here 4 mm), a significant amount of Br still occurs in the "narrowest" DP stack. Therefore, if the tape width is not increased gradually, the effect of the multi-width may be less pronounced.

With manufacturing difficulty taken into consideration, an exemplary range may be from 0.1 mm as the approximate minimum limit of the width variation and the 46 mm as the approximate maximum, based upon the narrowest and the widest tape generally commercially available. However, narrower and/or wider tape widths may be used.

While FIGS. 5B and 6B depict stacks 500 with three widths of DP coils 521, 522, 524, alternative embodiments may have as few as two widths of DP coils, or four, five, six, or more different width DP coils.

Relation Between DP Width and Magnet Performance

The center field $B_{0,MW}$ of the stack 500 is proportional to the ampere-turn of a magnet or equivalently to the overall current density multiplied by the magnet cross section. With a given winding area, the larger overall current density leads to the higher center field. Provided that the center field is mostly dominated by the DP coils 521 placed at and near the magnet center, the field contribution from those other coils 522, 524 is negligible, and the MW technique enables, at a given operating current, the enhancement of overall current density of the entire magnet by reducing the tape widths especially in the central DP coils 521, and ultimately contributes to improve the magnet performance.

Here a key parameter is the ratio, defined as a, of the widest tape width $w_{max}$ in the top and bottom DP coils 524 to the narrowest tape width $w_{min}$ in the central DP coils 521 as per Equation 1.

$$\alpha = w_{max}/w_{min} \quad \text{(Eq. 1)}$$

For example, $\alpha$ may be, but is not limited, to a range of 1-20.

Roughly, the center fields of an MW magnet ($B_{0,MW}$) and its single-width counterpart ($B_{0,SW}$) may be related by Equation 2 with an assumption that the overall magnet dimensions (inner diameter (i.d.), outer diameter (o.d.), and height) are identical between the MW and single-width magnets. So, theoretically, there is no limit to improve the field performance of an MW coil.

$$B_{0,MW} \approx \alpha B_{0,SW} \quad \text{(Eq. 2)}$$

Synergy of NI and MW

In a conventional prior art HTS magnet, the operating current, or more specifically the operating current density, is limited not only by the in-field performance of the HTS conductor but also by the protection requirement. If a quench, by definition a superconducting magnet accidently loses its superconductivity, occurs in a conventional insulated HTS magnet operated at a very high current density, for example, above 30 kA/cm$^2$, the magnet will burn even with the state-of-the-art protection scheme. On one hand the NI technique enables an HTS magnet to be self-protecting and thus to operate at a high current density, both features not possible with the conventional FITS magnet, shown experimentally to be self-protecting at approximately 150 kA/cm$^2$ operation. On the other hand, the MW technique is a suitable and highly effective approach to grade tape-wound DP coils. The combination of NI and MW techniques enables HTS magnets to be highly compact, which may lead to significant reduction in magnet price, capital and operation, one of the decisive factors in most laboratories.

Method

Figure 7:
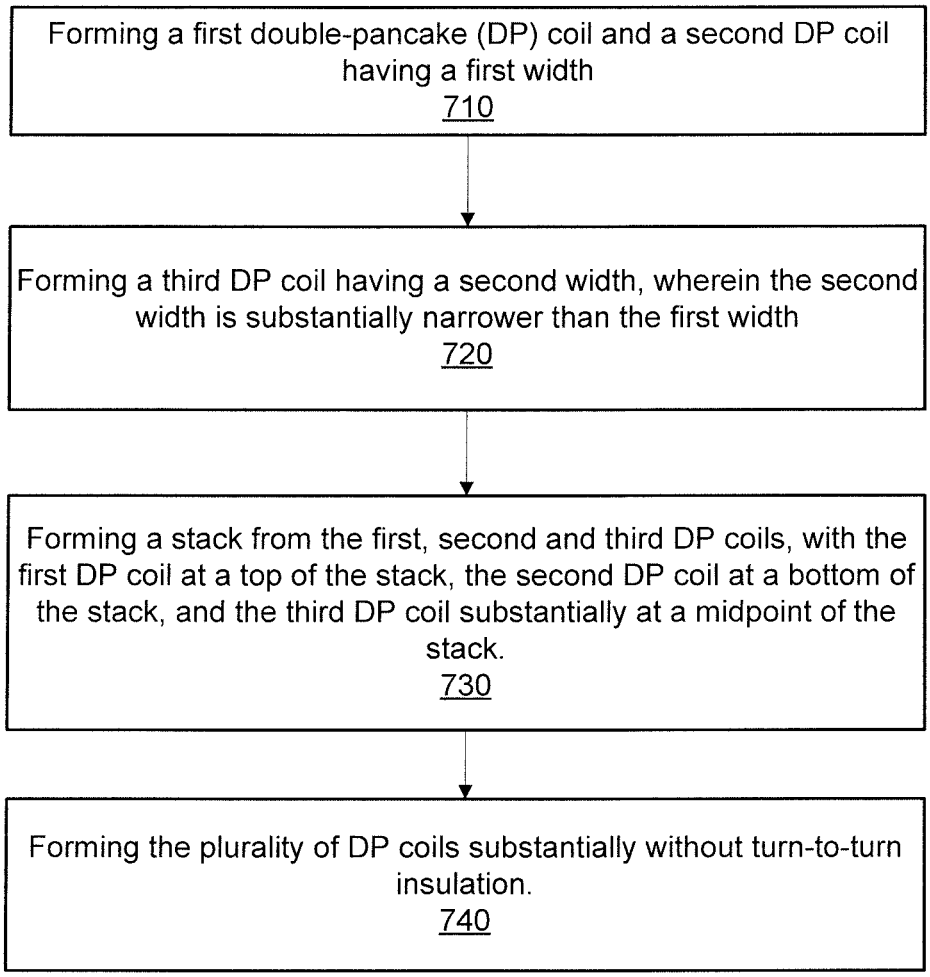
FIG. 7 is a flowchart of a method for forming a nuclear magnetic resonance device.

FIG. 7 is a flowchart of a method for forming an NI-MW HTS magnet. It should be noted that any process descriptions or blocks in flow charts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

The NI-MW magnet includes a plurality of DP coils, each DP coil having a first superconducting coil and a second superconducting coil. As shown by block 710, a first DP coil and a second DP coil having a first width are formed. A third DP coil having a second width is formed, wherein the second width is substantially narrower than the first width, as shown by block 720. A stack is formed from the first, second and third DP coils, with the first DP coil at a top of the stack, the second DP coil at a bottom of the stack, and the third DP coil substantially at a midpoint (magnetic mid-plane) of the stack, as shown by block 730. As shown by block 740, the plurality of DP coils are each formed substantially without turn-to-turn insulation.

Testing a Second Embodiment

Figure 8:
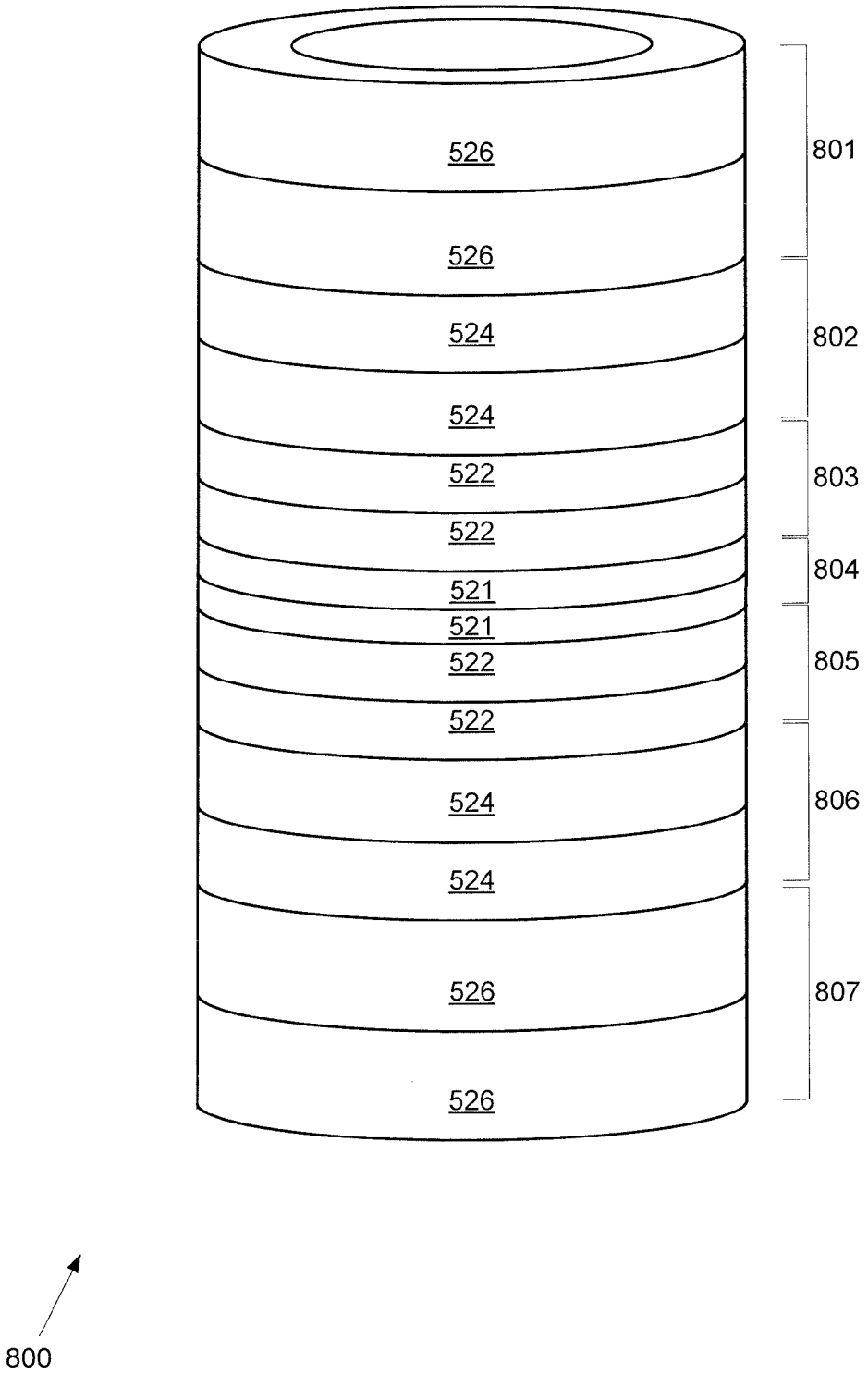
FIG. 8 is a schematic diagram of a second embodiment of a NI MW DP stack.

FIG. 8 shows a second exemplary embodiment of a No-Insulation (NI) Multi-Width (MW) Magnet Construction including a stack 800 of seven DP coils 801-807 wound with bare (no stabilizer) 2G conductor without turn-to-turn insulation. The conductor width is 2.5 mm for the center DP coil 804 and the conductor width increases to 4.0 mm for the top and bottom DP coils 801, 807. As a result, this MW magnet generates more field, for example, approximately 22% more field than its single-width (SW) counterpart. Table 1 presents key magnet parameters of the second embodiment.

TABLE 1

Key magnet parameters

| Parameters | Values |
|---|---|
| HTS wire width [mm] | 2.5-4.0 |
| HTS wire thickness [mm] | 0.08 |
| Stabilizer | n/a |
| Winding i.d.; o.d. [mm] | 40; 50 |
| Total height [mm] | 50 |
| # of DP coils | 7 |
| Turn per DP | 120 |
| $I_c$ @ 77 K [A] | 25 |
| Charging time constant [s] | 0.81 |
| Center field @ 1 A [mT] | 16.5 |
| Inductance [mH] | 18.9 |

A charge-discharge test was performed in a bath of liquid nitrogen at 77 K. The charge-discharge test compared spatial and temporal field performances of the NI-MW magnet 800 with those of its insulated (INS) and SW counterparts. An over-current test demonstrated the superior stability of the NI-MW magnet 800.

Figure 9:
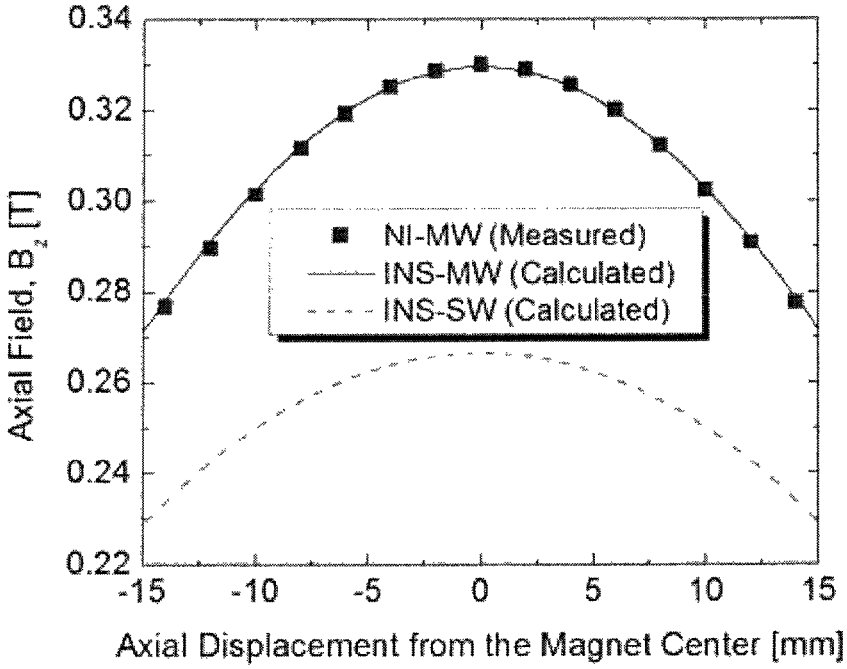
FIG. 9 is a plot of axial fields along the magnet center for the second embodiment.

In the spatial field performance test, the NI-MW magnet 800 was charged at 20 A (80% of the magnet critical current, 25 A), and the axial fields were measured along the magnet axis. FIG. 9 compares the measured fields (squares) with calculated fields of its INS-MW (lines) and INS-SW (dashes) versions. The INS-SW magnet is assumed to have a uniform overall current density equivalent to that of a magnet wound with all 4-mm wide tape alone. The results show that the spatial field performance of the NI magnet is virtually identical to that of its INS counterpart, and that the MW version generates 22% more field than its SW counterpart.

Figure 10:
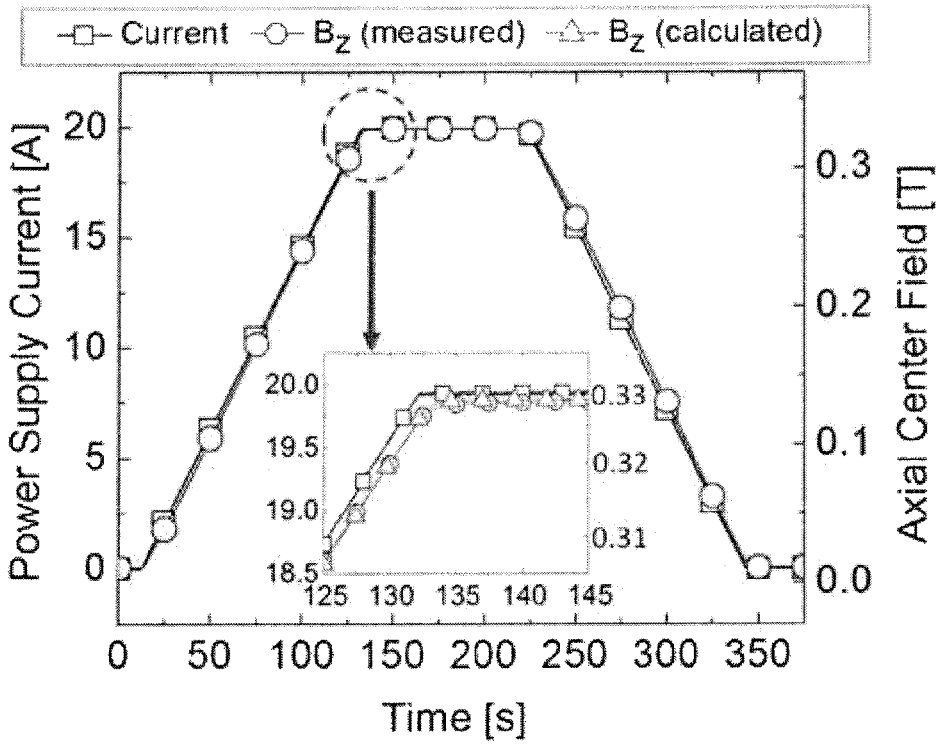
FIG. 10 is a plot of charge-discharge test results of the second embodiment.

Regarding temporal field performance, FIG. 10 shows power supply current and axial center field from a 20-A charge-discharge test. Squares indicate power supply current, circles indicate measured fields, and triangles indicate calculated fields by a proposed circuit model in FIG. 11. The inset of FIG. 10 shows an enlarged view of the plots near the end of charging, revealing a discernible delay (~1 s) between current and corresponding field. The time constants, 0.81 s (measured) and 0.79 s (calculated), agree well. The results validate the proposed circuit model (FIG. 11) to accurately characterize the electrical responses of an NI-MW magnet 800 (FIG. 8).

Figure 11:
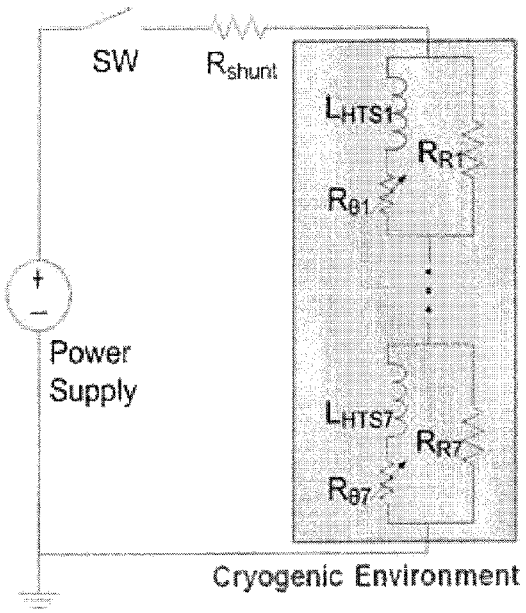
FIG. 11 is a circuit diagram of a test setup for the second embodiment.
Figure 12:
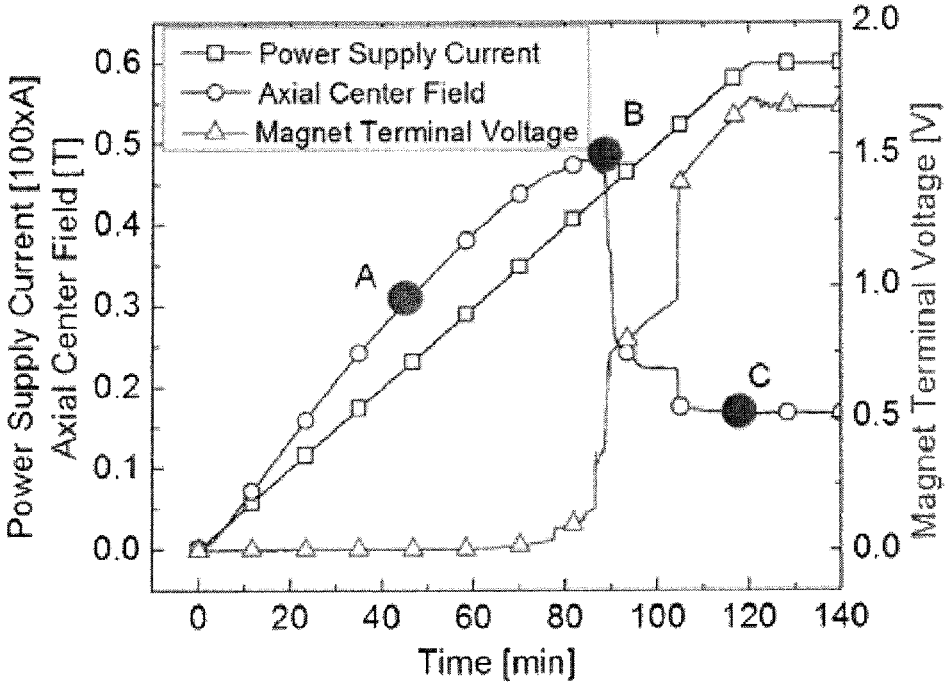
FIG. 12 is a chart of over-current test results for the second embodiment.

An over-current test was performed to determine the extent of self-protection provided by the second embodiment. In the over-current test, the NI-MW magnet 800 (FIG. 8) was charged up to 60 A at a rate of 0.5 A/min, a typical charging rate of prior art NMR magnets. FIG. 12 presents the test results. Squares indicate power supply current, circles indicate the axial center field, and triangles indicate terminal voltage. The axial field is proportional to the power supply current up to point A in FIG. 12 when the power supply current reaches the magnet critical current, 25 A. After point A, the axial field starts saturating because a portion of the power supply current begins automatically bypassing through turn-to-turn contacts ($R_R$ in FIG. 11) from its original spiral path. At B the axial field reaches its peak and starts decreasing. Although at C the power supply current, 60 A was 2.2 times larger than the magnet critical current, this NI-MW magnet 800 (FIG. 8) operated stably without overheating for the next 20 minutes or so. The test results were repeatable and the magnet 800 (FIG. 8) was not damaged. It is worth noting that the 2.5-mm wide conductor was burned at 43 A in a separate test performed under the same cryogenic condition, i.e., a bath of LN2 at 77 K.

The NI-MW magnet 800 (FIG. 8) was successfully charged and discharged. The spatial field distribution of the NI-MW magnet 800 (FIG. 8) under steady state was virtually identical to that of its insulated counterpart. The measured charging time constant, 0.81 s, is consistent with the proposed equivalent circuit model (FIG. 11).

The excellent thermal stability and self-protecting features of the NI-MW magnet 800 (FIG. 8) were demonstrated in LN2 at 77 K by over-current tests. In a reported over-current test, a 210-turn single pancake NI coil in LHe at 4.2 K coil survived without damage in a quench event with an operating current density of 158 kA/cm$^2$ 5 times larger than a nominal operating current density of typical high-field HTS magnets.

With a single 2.5-mm DP 804 (FIG. 8), the NI-MW magnet 800 (FIG. 8) generated 22% more field than its SW counterpart. If more 2.5-mm DP coils 804 (FIG. 8) are used at the center, the field was observed to increase by up to 1.6 times (4.0 mm/2.5 mm). With wider coils at the top and bottom of the magnet 800 (FIG. 8), the field increases further because the magnet 800 (FIG. 8) can operate at a higher current.

Prior art HTS magnets have not operated at a current density higher than 50 kA/cm$^2$ chiefly due to a widely held perception it was not possible to eliminate the extra stabilizer layer in high field HTS magnets. Although the MW technique significantly enhances the overall current density of an HTS magnet, without the NI technique incorporated, an MW-only magnet would be permanently damaged in an event of a quench during operation.

Impact

It is widely agreed that FITS magnet technology is essential not only to surpass the current NMR frequency record of all-LTS magnet, 1.0 GHz but also, especially under the current helium crisis (helium price has roughly quadrupled in the last decade), to enable commercial NMR magnets to be operated in LHe-free cryogenic conditions. NI and MW techniques provide small-footprint, self-protecting, LHe-free, HTS NMR magnets regardless of their RT bore sizes and field strengths. Ultimately, the proven NI and MW techniques benefit virtually all of DC (Direct Current) HTS magnet applications including electric power, magnetic levitation, as well as NMR/MRI, that require compactness, stable operation, mechanical integrity, and low cost.

In summary, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A high temperature superconducting magnet comprising:

a stack of a plurality of double-pancake (DP) coils, each DP coil comprising:

a first pancake coil wound of a plurality of adjoining winding turns of a superconductor material into a cylindrical structure; and a second pancake coil wound of a plurality of adjoining winding turns of said superconductor material into a cylindrical structure, wherein said first pancake coil is stacked upon said second pancake coil, and said first pancake coil and said second pancake coil each omit a turn-to-turn insulation, and said stack comprising:

a first DP coil having a first width and a first amount of superconductor disposed at a top of said stack;

a second DP coil having a second width and a second amount of superconductor disposed at a bottom of said stack; and a third DP coil having a third width and a third amount of superconductor disposed substantially at a midpoint of said stack, wherein said first amount of superconductor is substantially equal to said second amount of superconductor, said third amount of superconductor is substantially less than said first amount of superconductor, said first width is substantially equal to said second width, and said third width is substantially narrower than said first width.

2. The device of claim 1, wherein said plurality of DP coils substantially omit stabilizer conductor.

3. The device of claim 1, wherein said plurality of DP coils each have a substantially similar outer diameter.

4. The device of claim 3, wherein said plurality of DP coils each have a substantially similar number of turns.

5. The device of claim 1, further comprising:

a fourth DP coil having a fourth width disposed in said stack between said first DP coil and said third DP coil; and a fifth DP coil having a fifth width disposed in said stack between said third DP coil and said second DP coil, wherein said fourth width is substantially equal to said fifth width, said fourth width is substantially narrower than said first width, and said fourth width is substantially wider than said third width.

6. The device of claim 1, wherein said DP coil comprises a second generation (2G) high temperature superconductor wire.

7. The device of claim 6, wherein said 2G wire comprises a 2G tape.

8. The device of claim 1, wherein each DP coil in said stack has a substantial difference in width from each adjacent DP coil in said stack.

9. The device of claim 8, wherein said difference in width is between 5% and 90%.

10. A method of forming a high temperature superconducting magnet comprising a plurality of double-pancake (DP) coils, each DP coil comprising a first superconducting coil and a second superconducting coil, comprising the steps of:

winding a first DP coil with a first pancake and a second pancake each comprising a plurality of adjoining turns of a superconductor material into a cylindrical structure having a first width and a first amount of superconductor;

winding a second DP coil with a first pancake and a second pancake each comprising a plurality of adjoining turns of a superconductor material into a cylindrical structure having the first width and the first amount of superconductor;

winding a third DP coil with a first pancake and a second pancake each comprising a plurality of adjacent turns adjoining turns of said superconductor material into a cylindrical structure having a second width and a second amount of superconductor, wherein said second width is substantially narrower than said first width and said second amount of superconductor material is less than said first amount of superconductor material; and forming a stack of adjacent DP coils comprising, said first DP coil disposed at a top of said stack, said second DP coil disposed at a bottom of said stack, and said third DP coil disposed substantially at a midpoint of said stack, wherein said first pancake and said second pancake of each of said plurality of DP coils omit a turn-to-turn insulation.

11. The method of claim 10, wherein said plurality of DP coils substantially omit a thick turn-to-turn stabilizer.

12. The method of claim 10, wherein said plurality of DP coils each have a substantially similar outer diameter.

13. The method of claim 12, wherein said plurality of DP coils each have a substantially similar number of turns.

14. The method of claim 10, further comprising the steps of:

forming a fourth DP coil and a fifth DP coil having a third width;

positioning said fourth DP coil in said stack between said first DP coil and said third DP coil; and positioning said fifth DP coil in said stack between said second DP coil and said third DP coil;

wherein said third width is substantially narrower than said first width, and said third width is substantially wider than said second width.

15. The method of claim 10, wherein said superconducting coil comprises a second generation (2G) high temperature superconductor wire.

16. The method of claim 15, wherein said 2G wire comprises a 2G tape.

17. The method of claim 10, wherein each DP coil in said stack has a substantial difference in width from each adjacent DP coil in said stack.

18. The method of claim 17, wherein said difference in width is between 5% and 90%.

19. The device of claim 1, wherein the magnet produces a dominant magnetic field oriented radially outward from a center axis of the stack.

20. The device of claim 7, wherein the width of each coil is substantially equal to the width of the tape winding each coil.

* * * * *